United States Patent [19]

Tokita et al.

[11] Patent Number: 4,749,975

[45] Date of Patent: Jun. 7, 1988

[54] CATHODE RAY TUBE DEFLECTION DEVICE HAVING HEAT DISSIPATION MEANS

[75] Inventors: Kiyoshi Tokita; Kaneharu Kida, both of Fukaya; Michio Nakamura, Kamisato; Tooru Takahashi, Fukaya, both of Japan

[73] Assignee: Kabushiki Kaisha Toshiba, Kawasaki, Japan

[21] Appl. No.: 26,215

[22] Filed: Mar. 16, 1987

[30] Foreign Application Priority Data

| | | | |
|---|---|---|---|
| Mar. 19, 1986 | [JP] | Japan | 61-59509 |
| Jul. 28, 1986 | [JP] | Japan | 61-175579 |
| Jul. 28, 1986 | [JP] | Japan | 61-175580 |

[51] Int. Cl.[4] ..... H01F 7/00

[52] U.S. Cl. ..... 335/217; 335/210

[58] Field of Search ..... 335/210, 211, 213, 212, 335/217

[56] References Cited

U.S. PATENT DOCUMENTS

| | | | |
|---|---|---|---|
| 4,494,097 | 1/1985 | Lenders | 335/210 |
| 4,673,906 | 6/1987 | Petrow | 335/217 X |

FOREIGN PATENT DOCUMENTS

| | | | |
|---|---|---|---|
| 0167000 | 6/1985 | European Pat. Off. | 335/217 |
| 0147882 | 7/1985 | European Pat. Off. | 335/217 |
| C863224 | 1/1953 | Fed. Rep. of Germany | 335/217 |
| 59-186239 | 10/1984 | Japan | 335/299 |
| A972067 | 10/1964 | United Kingdom | 335/217 |
| 2147143 | 9/1984 | United Kingdom | 335/217 |

OTHER PUBLICATIONS

Patent Abstracts of Japan, unexamined applications, E section, vol. 8, No. 70, Apr. 3, 1984, The Patent Office Japanese Government, p. 134 E 235.

*Primary Examiner*—George Harris

*Attorney, Agent, or Firm*—Oblon, Fisher, Spivak, McClelland & Maier

[57] ABSTRACT

A deflection device generating magnetic field for electron beam deflection comprises, a cylindrical mold, a horizontal deflection coil provided inside the mold, a magnetic core attached to outside of the mold, a vertical deflection coil wound on the core, and magnetic member means for modifying deflection field distribution, interposed between the mold and vertical deflection coil.

The deflection device further includes a porous ceramic layer for heat dissipation coated on at least a part of the outer surfaces of the mold, horizontal deflection coil, vertical deflection coil and magnetic member means.

5 Claims, 4 Drawing Sheets

CATHODE RAY TUBE DEFLECTION DEVICE HAVING HEAT DISSIPATION MEANS

BACKGROUND OF THE INVENTION

This invention relates to a deflection device used in a cathode ray tube, and more particularly, to a deflection device suitable for high frequency deflection.

The horizontal deflection frequency usually employed in cathode ray tubes, for example, color cathode ray tubes, is 15.75 KHz. However, in tubes such as display tubes, where high resolution and improved visual recognition characteristics are required, conditions are now more commonly met that require the use of higher horizontal deflection frequencies, for example, 25 KHz and 31 KHz. In particular, some display tubes used in computer aided design and computer aided manufacturing applications, in which computers are used for technical design or for production control, operate with a horizontal deflection frequency of 64 KHz.

When deflection devices are operated with the high horizontal deflection frequencies referred to above, the following problem arises.

Specifically, the horizontal magnetic field produces eddy currents in the core and horizontal deflection coil constituting the deflection device, and these currents generate heat.

For example, the curve A shown in FIG. 7 plots horizontal deflection frequency vs. temperature rise. According to this curve, when the above display device for a 14-inch 90° deflection display tube is operated at the conventional horizontal deflection frequency, the temperature rise $\Delta T$ of the core is about 20° C. However, if it is operated at 64 KHz, this $\Delta T$ is about 70° C. The heat proof temperature of a polypropylene molt at which mold deformation may occur is about 105° C. When a deflection device for a 14-inch 90° deflection display tube is operated at 64 KHz in circumferential air at a temperature of 50° C., the core rises in temperature by about 70° C. as shown in FIG. 7. Thus the temperature in its vicinity, i.e. the temperature of the mold approaches 120° C. This causes deformation of the polypropylene mold. This is a serious problem from the point of view of performance and reliability. Of course, this can be overcome if a material of even higher thermal resistance is used, but this results in a large increase in material cost and/or required machining precision. This is very disadvantageous from the point of view of mass production. Japanese Patent Application Laid-open No. 59-186239 discloses a technique in which Litz wire is used to reduce the stray capacitance of the deflection coil to reduce the temperature rise due to eddy current losses. However, it has not proved possible to reduce heat generation sufficiently by this means alone.

In this case, the heat generated in the coil may be reduced. However, the heat generated in the core, and in the magnetic member attached between the core and the mold for adjusting the deflection field, cannot be limited. This magnetic member has a relatively low electric resistance due to the use of a silicon steel plate therein. This low resistnce causes an increase in the eddy current in the magnetic member according to a higher deflection frequency.

SUMMARY OF THE INVENTION

An object of this invention is to provide a stable deflection device wherein there is little evolution of heat even in operation at high horizontal deflection frequency.

According to this invention, a deflection device for a cathode ray tube comprises deflection means including an outer surface for deflecting electron beams horizontally and vertically in the tube, and heat dissipation means coated on at least a part of the outer surface for increasing the effective surface area and increasing the speed of heat dissipation from the device.

The typical heat dissipation means includes a porous ceramic layer. The ceramic layer with thermal dissipation is larger than that of the members constituting the deflection device.

The ceramic layer formed on the member surface has a specific surface area about 50 times the plane surface of the member itself, and so has good heat dissipation. It therefore limits the temperature rise of the member, particularly relatively high temperature rise member, e.g. magnetic member.

DETAILED DESCRIPTION OF THE EMBODIMENT

Figure 1:
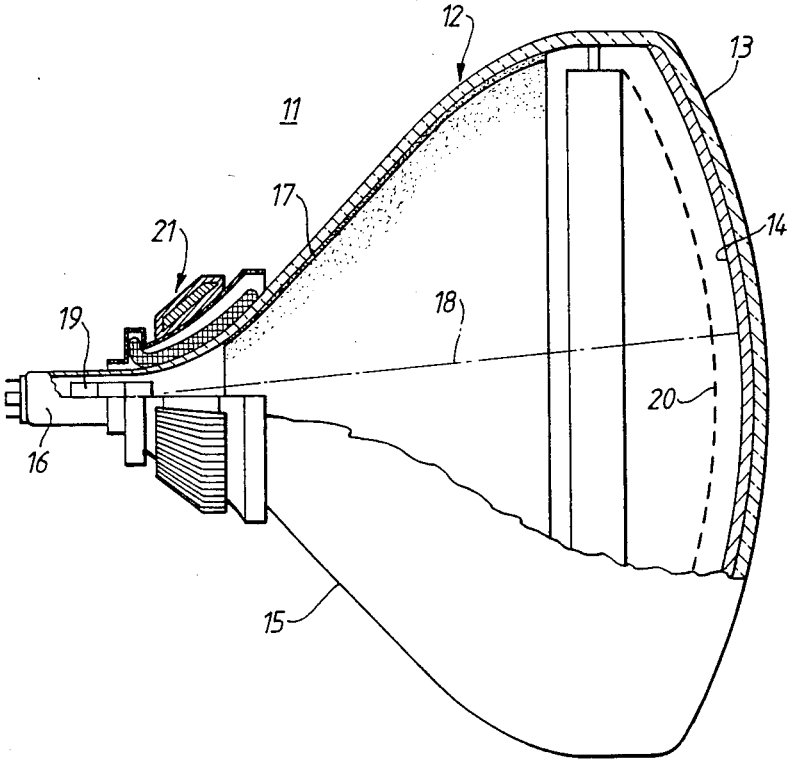
FIG. 1 is a partial cross-sectional view of an embodiment of this invention.
Figure 2:
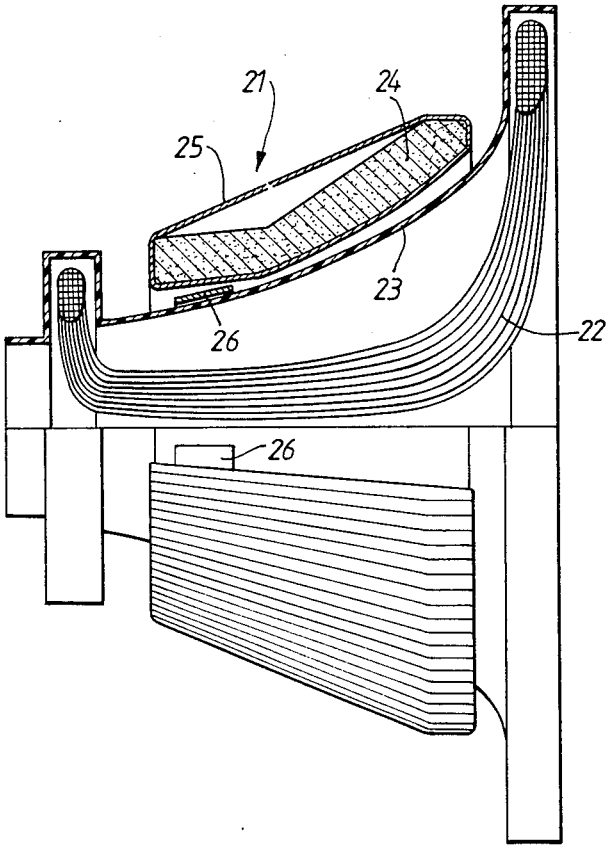
FIG. 2 is an enlarged partial cross-sectional view of the deflection device shown in FIG. 1.
Figure 3:
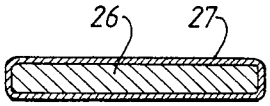
FIG. 3 is a cross-sectional view of the magnetic member and ceramic layer of the device of FIG. 1.

Referring now to FIGS. 1 through 3, one embodiment of the invention will be explained.

A color cathode ray tube 11 includes an evacuated glass envelope 12 having a panel 13 deposited inside with a phosphor screen 14 thereon. Phosphor screen 14 emits red, green and blue lights excited by electron beams 18. A funnel 15 is extended from panel 13, and a neck portion 16 extends from funnel 15. An internal electrode 17 is coated on the inside wall of funnel 15 and an electron gun assembly 19 is installed in neck portion 16. Electron gun assembly 19 generates three electron beams 18. A shadow mask 20 is further attached facing phosphor screen 14.

To the outside of neck portion 16 is attached a deflection device 21. The device 21 forms horizontal and vertical deflection fields in the path of electron beams 18 to deflect the electron beams, and the electron beams scan to impinge phosphor screen 13 through shadow mask 20.

Deflection device 21 includes a saddle type horizontal deflection coil 22, a conical cylindrical mold 23 made of synthetic resin, e.g., polypropylene on its inside with horizontal deflection coil 22, ferrite core 24 having two symmetrically-shaped half-sections surrounding the outside of mold 23, and a toroidal type vertical deflection coil 25 wound around core 24.

A magnetic member 26 including a pair of symmetrically arranged magnetic plate pieces facing each other, is interposed between the outside of mold 23 and the inside of vertical deflection coil 25. Magnetic member 26 modifies vertical field to a barrel distribution. Magnetic member 26 in FIG. 3 is silicon steel, and a porous ceramic layer 27 is formed on its surface. Porour ceramic layer 27 is formed by applying the following suspension of an alkoxide compound of zirconium and silicon, for example $ZrSi(OC_4H_9)_4$, containing zircon ($ZrSiO_4$) as a filler. The layer 27 is applied by a spray method to produce a coating of about 10 microns thickness, and is then heat-treated.

An exemplary composition for the coating is as follows:

Zircon: 500 gr
Alkoxide compound of silicon and zirconium: 100 gr
Isopropyl alcohol: 400 gr For applying the suspension, the spray method is most suitable. In this case, if the suspension is sprayed with a spray pressure of about 3 $kg/cm^2$ from a distance of 20 cm to 30 cm, a thickness of about 10 microns can be formed in about 3 seconds. After applying the alkoxide compound of silicon and zirconium, a porous ceramic layer 27 can be obtained as shown in FIG. 3 by heating the magnetic member in air at 70° C. or more. Under these conditions, this alkoxide compound of silicon and zirconium applied to magnetic member 26 is hydrolysed by the moisture in the air. As a result, a film is formed by a polycondensation reaction of the alkoxides, to produce metallic oxide compounds containing silicon and zirconium, i.e. a porous ceramic layer. It should be noted that although in the above example heating was applied after application of the suspension, it is possible to eliminate the subsequent heat treatment step in order to shorten production time. This is done by applying the suspension while heating to 70° C. or more. It has also been ascertained that a sufficient degree of hydrolysis can be achieved even at room temperature, instead of in an atmosphere at 70° C. or more, if the surface of magnetic member 26 is irradiated with infra-red radiation while coating the suspension containing the alkoxide compound. This is a result of the good absorption characteristic of this alkoxide compound of silicon and zirconium for electromagnetic radiation in the infra-red region. It is also possible to irradiate with infra-red radiation after coating.

The inventors carried out a detailed investigation of the temperature rise of the magnetic member of a deflection device to which this invention had been applied, when a 14-inch 90° deflection display tube was operated.

Figure 6:
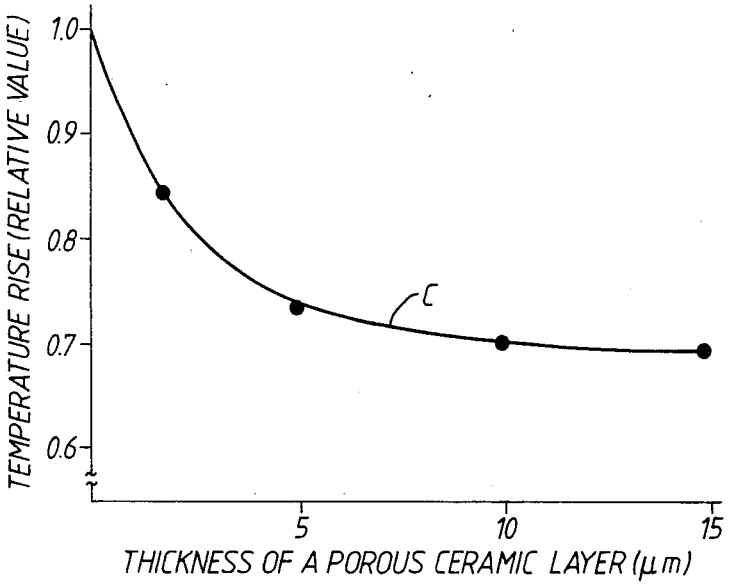
FIG. 6 is a curve of porous ceramic layer thickness vs. temperature rise of a magnetic member for illustrating this invention.
Figure 7:
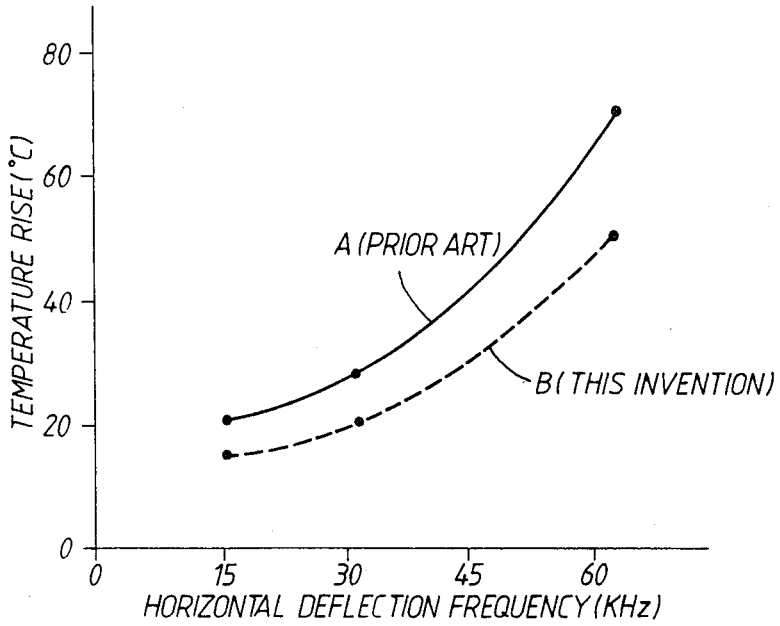
FIG. 7 shows curves of horizontal deflection frequency vs. temperature rise of respective magnetic members of this invention and a prior art device.

The results of this investigation are shown in FIG. 6. The axis of abscissa shows the thickness of porous ceramic layer 27 containing metallic oxides of silicon and zirconium. The axis of ordinate shows the temperature rise when this magnetic member 26 was operated. The temperature rise is expressed in terms of a relative value calculated using the case where no porous ceramic layer was formed as a standard. It can be clearly seen fromm the curve C of FIG. 6 that the rise in temperature of the magnetic member is restricted by the formation of the porous ceramic layer on the surface of the magnetic member. As a result, as shown curve B in FIG. 7, the temperature rise of the magnetic member of this embodiment is reduced to a limit of at most 50° C. at 64 KHz deflection frequency. The temperature was measured by means of a thermocoupler interposed between the magnetic member surface and the ceramic layer. This is because the heat dissipation is greatly increased by the ceramic layer. The specific surface area of the porous ceramic layer formed on the surface of the magnetic member is about 50 times the specific surface area of the magnetic member. In other words, the effective surface area of the porous ceramic layer is about 50 times the surface area of the magnetic member itself. The specific surface area was measured by the BET method which was calculated from the amount of low-pressure nitrogen gas absorbed.

In FIG. 6, it can be seen that the temperature controlling effect of the porous ceramic layer is saturated. when the thickness of the porous ceramic layer is more than 10 microns. It is believed that when the porous ceramic layre gets thicker, those parts of the porous ceramic layer which are close to the magnetic member surface, that is, the deeper parts of the porous ceramic layer, do not contribute much to the heat dissipation. The major contribution to the heat dissipation comes from those parts of the porous ceramic layer which are near its outer surface. The ceraic layre of this embodiment of the invention has good electrical insulating properties and is non-magnetic, so it clearly has no effect on the magnetic action of the deflection device itself. Additionally, since the porous ceramic layer containing metallic oxides of silicon and zirconium can be sintered at low temperature, there is no risk at all of altering the magnetic properties of the magnetic member by the application of the sintering temperature to this porous ceramic layer. This is also a great advantage from the point of view of industrial mass production. As described above, in the members which the deflection yoke includes, the magnetic member suffers the highest temperature rise in all members from high frequency deflection. Coating the porous ceramic layer on the surface of such a magnetic member effectively reduces heat generating therein. Further, use of the porous ceramic coating for the other members may enhance the speed of heat dissipation much more. Also, one of the other members, a magnetic adjusting member may be contained, which is attached to the deflection device and controls deflection field distribution, utilizing the leakage flux of the deflection coil (referred to Kamijo, U.S. Pat. No. 4,257,028).

Figure 4:
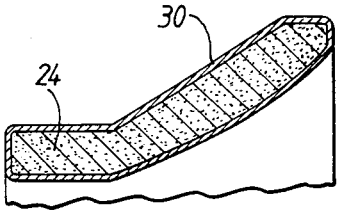
FIG. 4 is a cross-sectional view of a magnetic core and ceramic layer of another embodiment of this invention.

Referring to FIG. 4, in another embodiment of the invention, porous ceramic layer 30 is deposited on the surface of the magnetic core 24, which is surrounded by a vertical deflection coil 25. Since porous ceramic layer 30 notably increases the surface area of core 24, the heat dissipation of core 24 is enhanced and the temperature rise of the deflection device is lowered.

The porous ceramic layer, although being substantially white in color, has relatively high heat radiation properties as compared with the black ferrite core.

Figure 5:
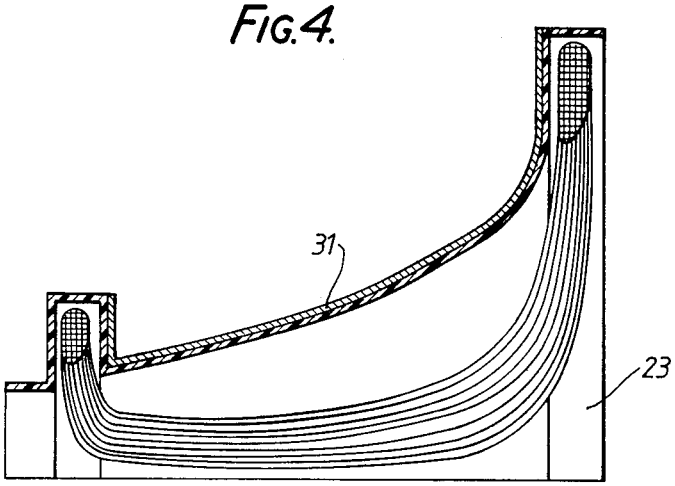
FIG. 5 is a cross-sectional view of a portion of another embodiment of this invention.

Another embodiment of the invention shown in FIG. 5 has a synthetic resin mold 23 with a porous ceramic layer 31 deposited on the surface thereof.

Ceramic layer 31 effectively cools mold 23 to restrain the temperature rise of the mold. The porous ceramic layer 31 may be firmly fixed on the surface by roughening the surface with sand paper, sand blasting etc.

Further, the porous ceramic layer may be coated on the other members, such as the horizontal deflection coil and the vertical deflection coil. The coating also may be applied to a plurality of members constituting the deflection device, for further enhancing cooling. Surfaces of the members may be roughened before coating. A non-core type coil also can be used as the vertical deflection coil.

As described above, according to this invention, a deflection device of high reliability can be obtained in which there is faster dissipation of heat from the members of the device even at high horizontal deflection frequencies.

We claim:

1. A deflection device for a cathode ray tube, comprising:

deflection means including an outer surface for deflecting electron beams horizontally and vertically in the tube; and heat dissipation means having a porous ceramic layer coated on at least a part of the outer surface for increasing the effective surface area and increasing the speed of heat dissipation from the device.

2. The device of claim 1, also including a cylindrical mold surrounding the device, and wherein the deflection means includes a horizontal deflection coil, a vertical deflection coil, and magnetic member means between the vertical deflection coil and the mold for modifying the distriution of the deflection field, the porous ceramic layer being coated on the magnetic member means.

3. The device of claim 2, wherein the deflection means also includes a magnetic core surrounding the mold and having an outer face, the outer face including a coating of the porous ceramic layer.

4. The device of claim 2, wherein the mold also includes a coating of the porous ceramic layer.

5. The device of claim 1, wherein the ceramic layer includes a metallic oxide of silicon and zirconium.

* * * * *